US008337261B2

(12) United States Patent
Hemmi et al.

(10) Patent No.: US 8,337,261 B2
(45) Date of Patent: Dec. 25, 2012

(54) CONTACTS FORMED BY ELECTROFORMING AND EXTENDED IN DIRECTION ROUGHLY PERPENDICULAR TO VOLTAGE APPLICATION DIRECTION IN ELECTROPERFORMING

(75) Inventors: Yoshinobu Hemmi, Kyoto (JP); Kazumasa Seki, Kyoto (JP); Shogo Nagasaka, Kyoto (JP); Toshio Yamashita, Kyoto (JP)

(73) Assignee: OMRON Corporation, Kyoto (JP)

( * ) Notice: Subject to any disclaimer, the term of this patent is extended or adjusted under 35 U.S.C. 154(b) by 308 days.

(21) Appl. No.: 12/595,089

(22) PCT Filed: Apr. 7, 2008

(86) PCT No.: PCT/JP2008/056879

§ 371 (c)(1),
(2), (4) Date: Oct. 8, 2009

(87) PCT Pub. No.: WO2008/126826

PCT Pub. Date: Oct. 23, 2008

(65) Prior Publication Data

US 2010/0065430 A1 Mar. 18, 2010

(30) Foreign Application Priority Data

Apr. 11, 2007 (JP) ..... 2007-103892

(51) Int. Cl.
*H01R 4/48* (2006.01)

(52) U.S. Cl. ..... 439/862; 439/660; 439/74; 439/884

(58) Field of Classification Search ..... 439/660, 439/74, 862, 884, 885
See application file for complete search history.

(56) References Cited

U.S. PATENT DOCUMENTS

| | | | | |
|---|---|---|---|---|
| 6,533,614 | B1 * | 3/2003 | Akama et al. | 439/607.05 |
| 6,881,075 | B2 * | 4/2005 | Huang et al. | 439/74 |
| 7,195,495 | B2 * | 3/2007 | Takano et al. | 439/74 |
| 2002/0028589 | A1 * | 3/2002 | Crane, Jr. | 439/74 |
| 2005/0085132 | A1 * | 4/2005 | Chai et al. | 439/660 |

FOREIGN PATENT DOCUMENTS

| | | | |
|---|---|---|---|
| JP | 09-073959 | A | 3/1997 |
| JP | 2003-232809 | A | 8/2003 |
| JP | 2004-055436 | A | 2/2004 |
| JP | 2006-066349 | A | 3/2006 |
| JP | 3774968 | B2 | 3/2006 |
| JP | 2006-114268 | A | 4/2006 |
| JP | 2007-086025 | A | 4/2007 |
| WO | 9744676 | A1 | 11/1997 |

OTHER PUBLICATIONS

Notification of Transmittal of Translation of the International Preliminary Report on Patentability from PCT/JP2008/056879, dated Oct. 22, 2009 (6 pages).
Office Action in Chinese Patent Application No. 200880011637.3, Dated Jan. 13, 2011 (9 Pages with English Translation).

(Continued)

*Primary Examiner* — Tho D Ta
(74) *Attorney, Agent, or Firm* — Osha Liang LLP

(57) ABSTRACT

A contact formed by electroforming and extended in a direction roughly perpendicular to a voltage application direction in the electroforming has a contact portion disposed at one end of the contact, which is brought into sliding contact with a conductive member along the voltage application direction in the electroforming.

7 Claims, 13 Drawing Sheets

OTHER PUBLICATIONS

Notification of reason for refusal for Korean Application No. 10-2009-7019859 mailed Mar. 18, 2011, with English translation thereof (9 pages).

Patent Abstracts of Japan, Publication No. 2004-055436, published on Feb. 19, 2004, 1 page.

Patent Abstracts of Japan, Publication No. 2006-066349, published on Mar. 9, 2006, 1 page.

Patent Abstracts of Japan, Publication No. 10-189168, published on Jul. 21, 1998, 1 page (Corresponds to JP3774968 cited herein).

Patent Abstracts of Japan, Publication No. 2003-232809, published on Aug. 22, 2003, 1 page.

Patent Abstracts of Japan, Publication No. 2006-114268, published on Apr. 27, 2006, 1 page.

Patent Abstracts of Japan, Publication No. 2007-086025, published on Apr. 5, 2007, 1 page.

Patent Abstracts of Japan, Publication No. 09-073959, published on Mar. 18, 1997, 1 page.

International Search Report issued in PCT/JP2008/056879, mailed on May 1, 2008, with translation, 4 pages.

* cited by examiner

CONTACTS FORMED BY ELECTROFORMING AND EXTENDED IN DIRECTION ROUGHLY PERPENDICULAR TO VOLTAGE APPLICATION DIRECTION IN ELECTROPERFORMING

TECHNICAL FIELD

The present invention relates to contacts and a connector.

BACKGROUND ART

For example, in a multi-pole connector mounted to a printed wiring board and connecting printed wiring boards so that they are superimposed, it is desired that the connector is shortened (a height reduction) in a fitting direction due to a reduction in size of equipment for housing a circuit.

In order to reduce the height of the connector, it is necessary to shorten each contact (conductive terminal) in a fitting direction. The contacts require an elastic force for being press-fitted to each other in order to secure a conductive contact, and a fitting length to some extent so that the contacts are not easily separated.

As described in Patent Documents 1 and 2, in a case where contacts are formed by bending a metal plate, a radius dimension for bending is required, so that there is a limitation in reducing the height in order to secure the fitting length. Further, in a case where contacts are formed by subjecting a metal plate having a certain plate thickness to bending work, an elastic force is controlled by the plate thickness. As a method for adjusting the elastic force of the metal plate, there is a method in which a metal plate is subjected to press working (crushing, beating) to partially change the thickness. However, residual stresses or lattice defects occur due to the press working, so that the connector has a shorter lifetime, and variations in thickness become large on a product-to-product basis.

Patent Document 3 discloses a connector in which pins and sockets that are erected in a normal line direction of substrates are formed by a plating technique. The sockets of Patent Document 3 are each elastically deformed so as to fall on the substrate when receiving the pins. For increasing a deformation amount of each pin, it is necessary to increase a height of the socket so that an elastically deformed region is increased. Therefore, as in the connectors of Patent Documents 1 and 2, if the pins and the sockets are provided with an overlap in a fitting direction to improve a retention force, or a click feeling that a user feels attachment and detachment is imparted, a length of the connector becomes longer in the fitting direction.

In addition, since the contacts used for such small-type connectors are extremely small, forming them by machining is not realistic.

Patent Document 1: Japanese Laid-Open Patent Application No. 2004-55436

Patent Document 2: Japanese Patent Laid-Open Application No. 2006-66349

Patent Document 3: Japanese Patent No. 3774968

DISCLOSURE OF INVENTION

One or more embodiments of the present invention provides contacts having a desired elastic force and a sufficient fitting length, and a height-reduced connector having a small dimension in a fitting direction.

A contact according to one or more embodiments of the present invention is formed by electroforming and extended in a direction roughly perpendicular to a voltage application direction in the electroforming, the contact having at its one end a contact portion, which is brought into sliding contact with a conductive member along the voltage application direction in the electroforming.

With this construction, since the contact, which is extended long in the direction roughly perpendicular to the voltage application direction, is formed by electroforming, an extra structure such as a bend is not required in the direction in which the contact portion is brought into sliding contact with the conductive member (fitting direction), so that it is possible to reduce the dimension in the fitting direction.

The contact according to one or more embodiments of the present invention may have a retention portion fixed by an insulating material and an elastically deformable spring portion that connects the contact portion and the retention portion, and the spring portion may elastically deform in the direction perpendicular to the voltage application direction in the electroforming.

With this construction, since the spring portion, which is extended roughly perpendicular to the voltage application direction, which coincides with the direction in which the contact portion is brought into sliding contact with the conductive member, is formed by electroforming, the spring portion is shorter in the direction in which the spring portion is brought into sliding contact with the conductive member. Further, by changing a cavity width of a mold for electroforming, a thickness of the spring portion is changed, so that the contact portion can be press-contacted with the conductive member with desired elasticity. Therefore, the contact according to one or more embodiments of the present invention can be shortened in the fitting direction while securing the fitting length and the press-contacting force sufficient for the conductive contact.

In the contact according to one or more embodiments of the present invention, the spring portion is curved in the voltage application direction, whereby the height at which the contact portion is retained in the voltage application direction in the electroforming is made different from the height at which the retention portion is retained, so that the sliding contact distance of the contact portion with respect to the conductive member can be increased.

In the contact according to one or more embodiments of the present invention, if an electrode portion connected to a circuit is extended from the retention portion to an opposite side of the spring portion, the contact can be easily incorporated into the circuit.

In the contact according to one or more embodiments of the present invention, an end of the contact portion is provided with a press-fitting portion, which is formed by continuously protruding only a portion of the end of the contact portion in the voltage application direction in the electroforming.

With the construction, the press-fitting portion is cut into a housing of a connector, thereby being able to be firmly fixed. Further, in electroforming, since it is possible to form a sharp press-fitting portion with extremely small dimensions, which continues in the voltage application direction, a recess in the housing for receiving the press-fitting portion may be small. Therefore, the strength of the housing is not impaired.

In the connector according to one or more embodiments of the present invention, a plurality of any one of the contacts are arranged and retained in the direction perpendicular to the voltage application direction in the electroforming.

With this construction, it is possible to provide a height-reduced connector having a small dimension in the fitting direction.

According to one or more embodiments of the present invention, the contact is formed by electroforming by applying a voltage in the direction of sliding contact with the conductive member. The contact is formed so as to be elastically deformable such that the respective portions of the contact are moved in the plane perpendicular to the voltage application direction in electroforming, whereby small-size contacts and a connector, which can achieve a reliable conductive contact, can be provided.

DESCRIPTION OF NUMERALS

Figure 1:
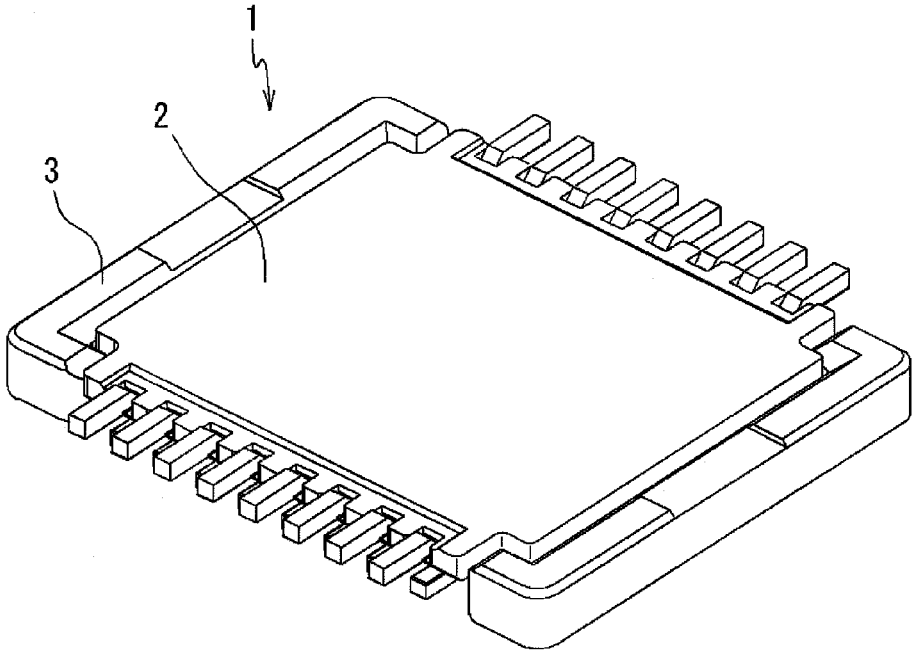
FIG. 1 is a perspective view of a connector of one embodiment of the present invention.

1 connector
2 socket (first connection member)
3 plug (second connection member)
4 housing
5 female-type contact
6 housing
7 male-type contact
8 retention portion
9 spring portion
10 contact portion
11 electrode portion
13 contact projection
14 retention portion
15 arm portion
16 electrode portion
17 contact surface
18 level difference
19 press-fitting portion
21 mold
22 cavity
23 insulating film

BEST MODE FOR CARRYING OUT THE INVENTION

In embodiments of the invention, numerous specific details are set forth in order to provide a more thorough understanding of the invention. However, it will be apparent to one of ordinary skill in the art that the invention may be practiced without these specific details.

In other instances, well-known features have not been described in detail to avoid obscuring the invention.

An embodiment of the present invention will hereinafter be described with reference to the drawings.

FIG. 1 shows a connector 1 of one embodiment of the present invention. The connector 1 consists of a socket (first connection member) 2 and a plug (second connection member) 3.

Figure 2:
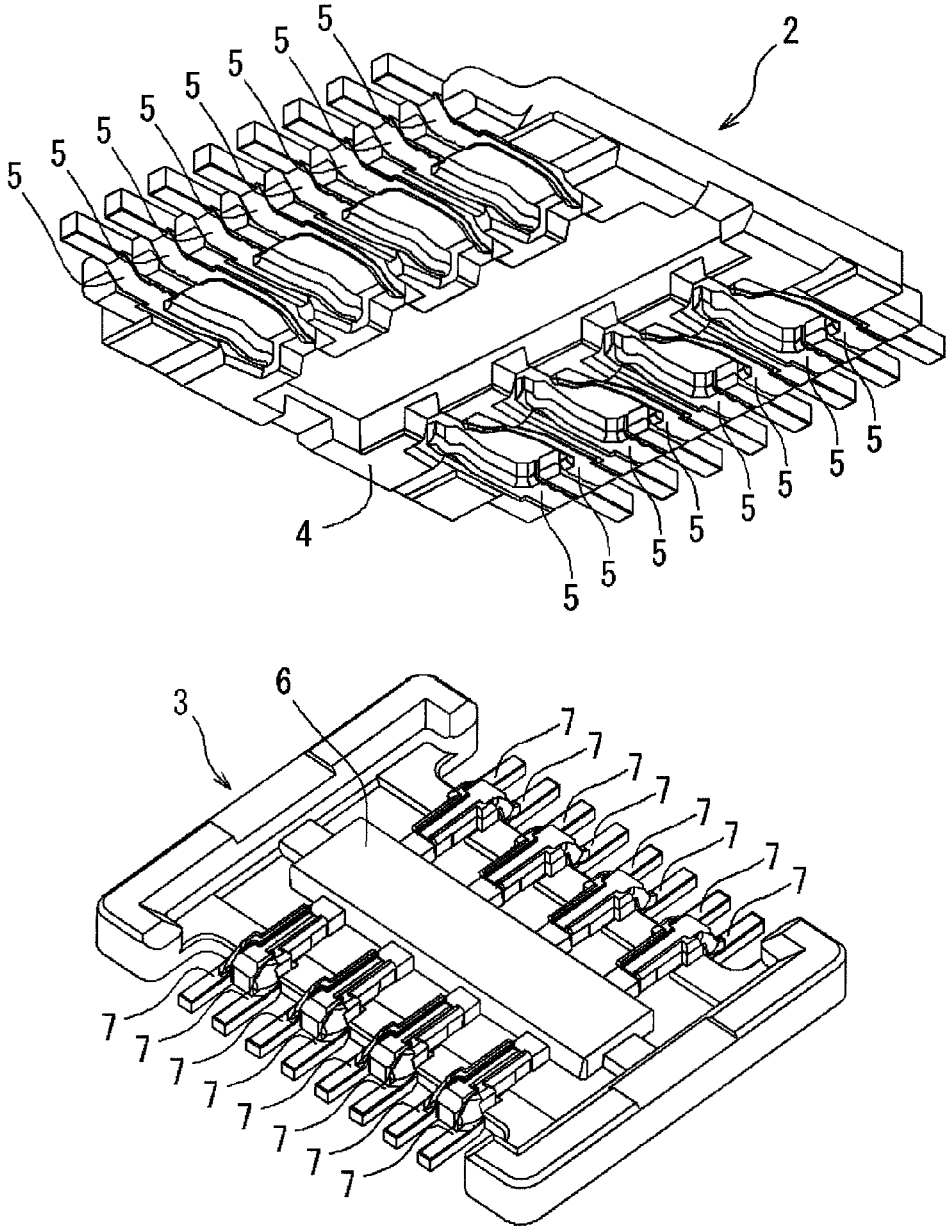
FIG. 2 is a perspective view in a state in which the connector of FIG. 1 is separated into a plug and a socket.
Figure 3:
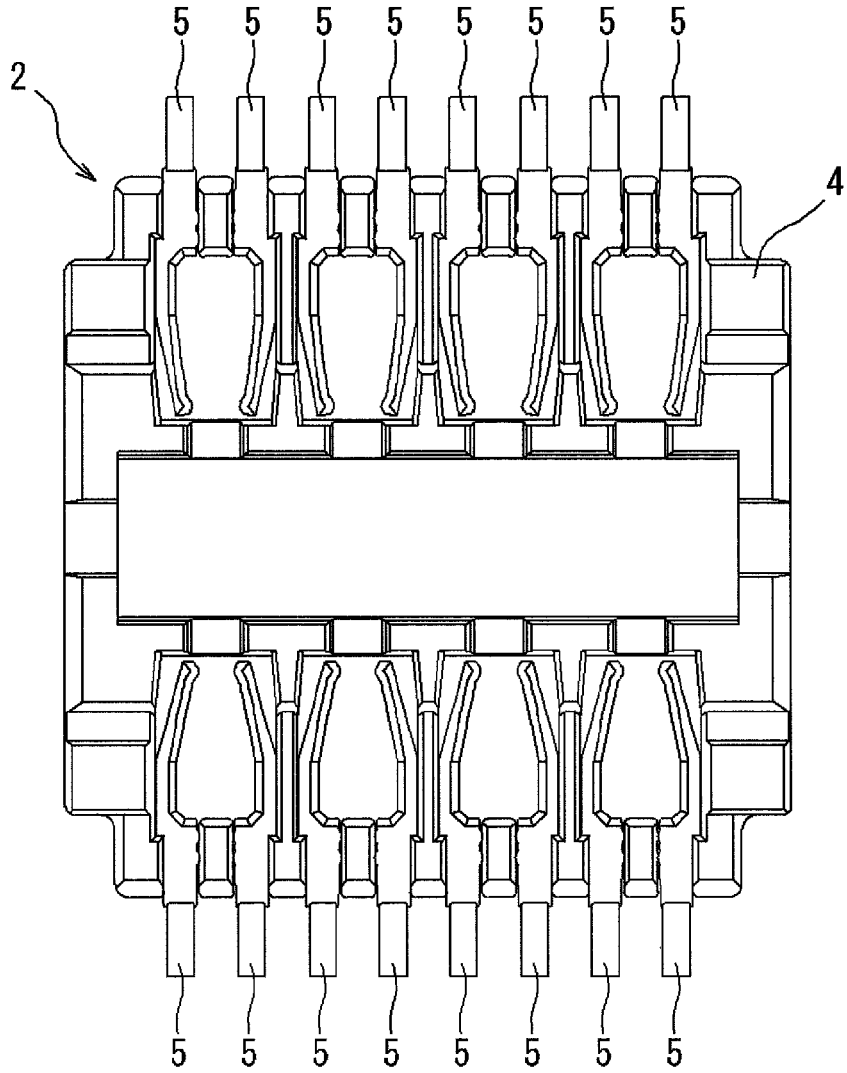
FIG. 3 is an elevational view of the socket of the connector of FIG. 2.
Figure 4:
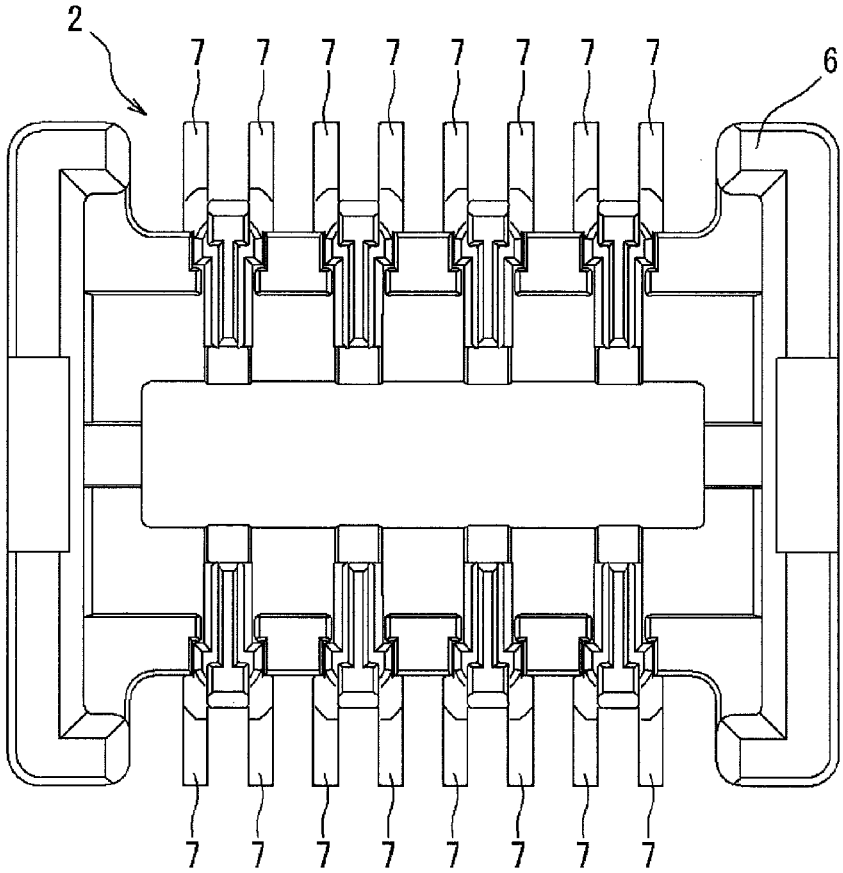
FIG. 4 is an elevational view of the plug of the connector of FIG. 2.

As shown in FIG. 2 and FIG. 3, the socket 2 retains a plurality of pairs of right and left female-type metal contacts 5 arranged in a plastic housing 4. Also, as shown in FIG. 2 and FIG. 4, the plug 3 retains a plurality of pairs of right and left male-type metal contacts (conductive members) 7 arranged in a plastic housing 6.

If the plug 3 is fitted into the socket 2, male type contacts 7 of each pair are interposed between facing female-type contacts 5 of each pair, so that the female-type contacts 5 and the male-type contacts 7 are conductively contacted.

Figure 5:
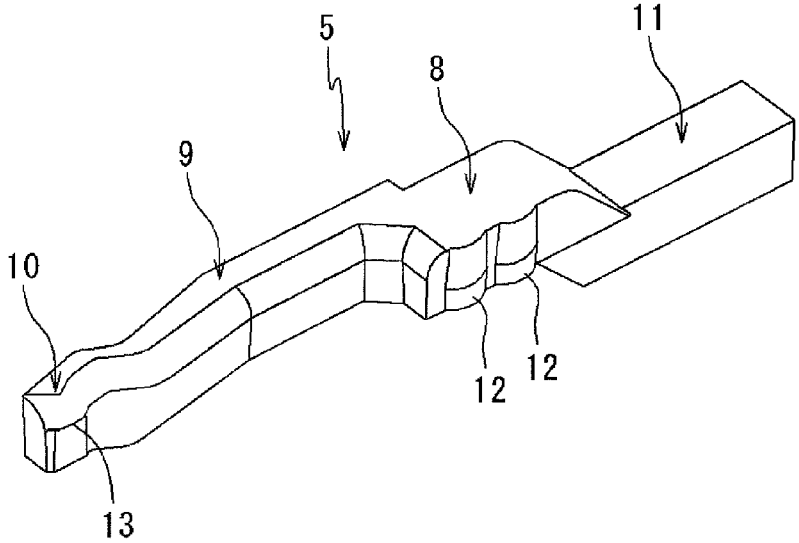
FIG. 5 is a perspective view of a female-type contact of the socket of FIG. 2.
Figure 6:
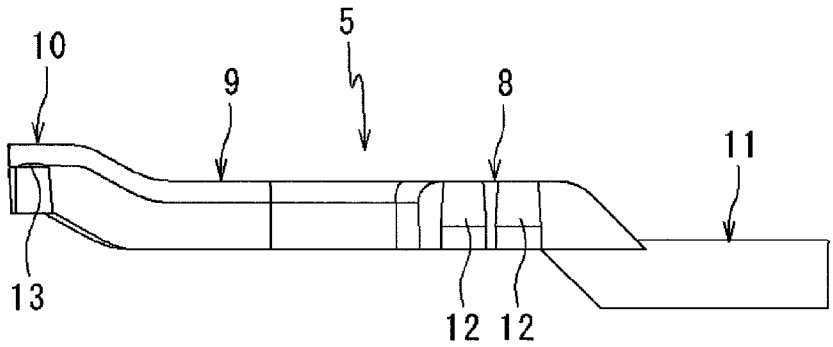
FIG. 6 is a side view of the female-type contact of FIG. 5.
Figure 7:
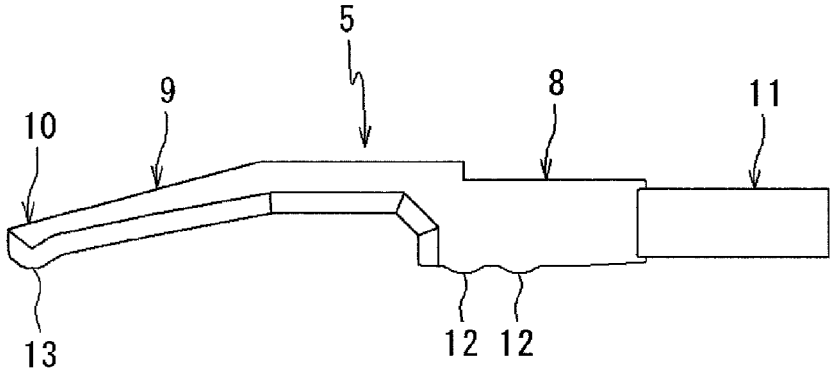
FIG. 7 is an elevational view of the female-type contact of FIG. 5.

FIGS. 5, 6, 7 show the detailed shape of a female-type contact 5. The female-type contact 5 comprises a retention portion 8 retained in the housing 4, a spring portion 9 extending from the retention portion 8, a contact portion 10 formed at an end of the spring portion 9, and an electrode portion 11 extending from the retention portion 8 to an opposite side of the spring portion 9.

The retention portion 8 includes two press-fitting portions 12, which bulge in a barrel shape at its lateral side. The press-fitting portions 12 are cut into the plastic housing 4 so as to be firmly retained in the housing 4.

The end of the spring portion 9 becomes thin and is curved halfway so that the contact portion 10 and the retention portion 8 are at different levels.

The contact portion 10 laterally protrudes, and includes a contact projection 13 that comes in contact with a male-type contact 7.

The electrode portion 11 protrudes from the housing 4 and is connected to an external circuit. For example, the electrode portions 11 are respectively soldered to pad electrodes provided on a circuit board.

Figure 8:
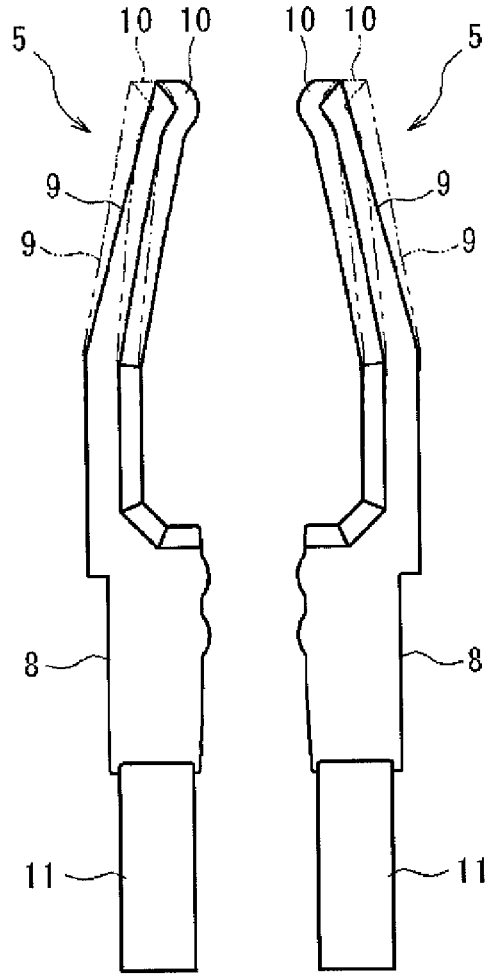
FIG. 8 is an elevational view showing elastic deformation of the female-type contact of FIG. 5.

As shown in FIG. 8, the spring portions 9 of the female-type contacts 5 are elastically deformed by an external force so as to be able to increase a distance between the facing contact portions 10 in a state in which the retention portions 8 are retained in the housing 4.

Figure 9:
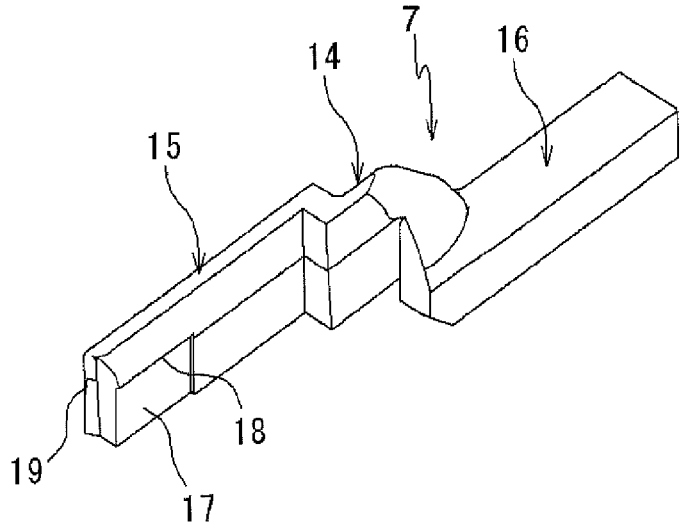
FIG. 9 is a perspective view of a male-type contact of the plug of FIG. 2.
Figure 10:
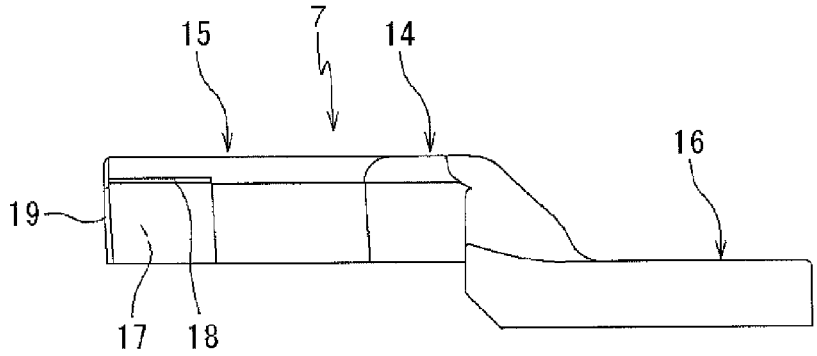
FIG. 10 is a side view of the male-type contact of FIG. 9.
Figure 11:
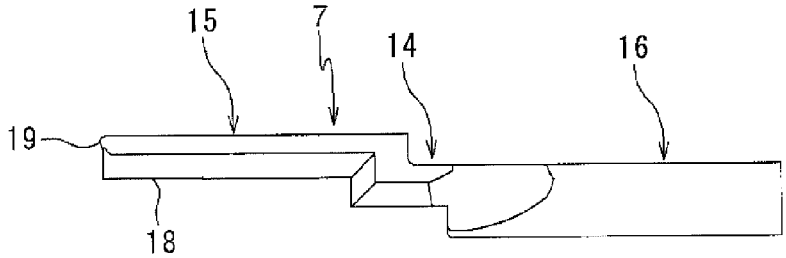
FIG. 11 is an elevational view of the male-type contact of FIG. 9.

Further, as shown in FIGS. 9, 10, 11, the male-type contact 7 comprises a retention portion 14 retained in the housing 6, an arm portion 15 extending from the retention portion 14, and an electrode portion 16 extending from the retention portion 14 to an opposite side of the arm portion 15.

An end portion of the arm portion 15 is formed with a slightly recessed contact surface 17 with which the contact projection 13 of the female-type contact (conductive member) 5 comes in contact. An upper portion of the arm portion 15 has a level difference 18 (contact portion).

Figure 12:
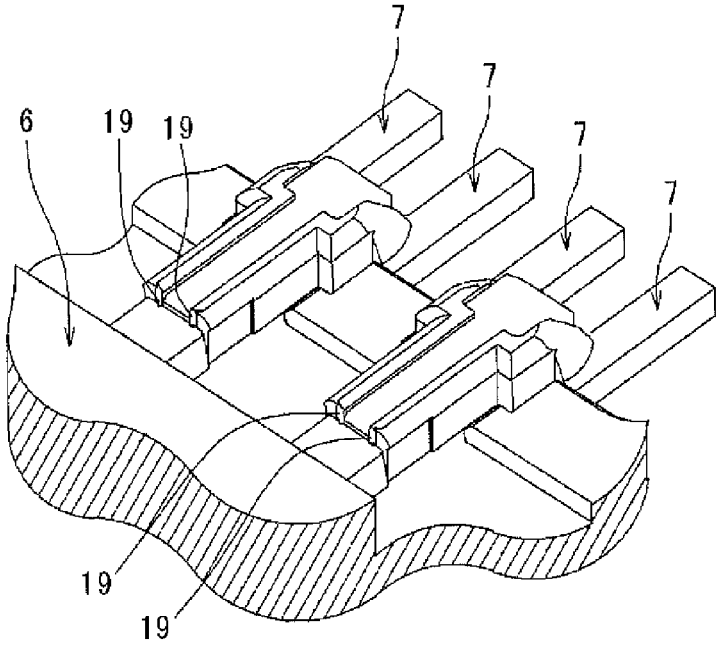
FIG. 12 is a partially enlarged perspective view of the male-type contacts and a housing of FIG. 4.

Further, an end of the arm portion 15 is provided with a press-fitting portion 19, which is formed by longitudinally and continuously protruding a portion in the width direction of the end thereof. As shown in FIG. 12, the press-fitting portion 19 is cut into the housing 6, whereby displacement of the arm portion 15 is prevented.

Figure 13:
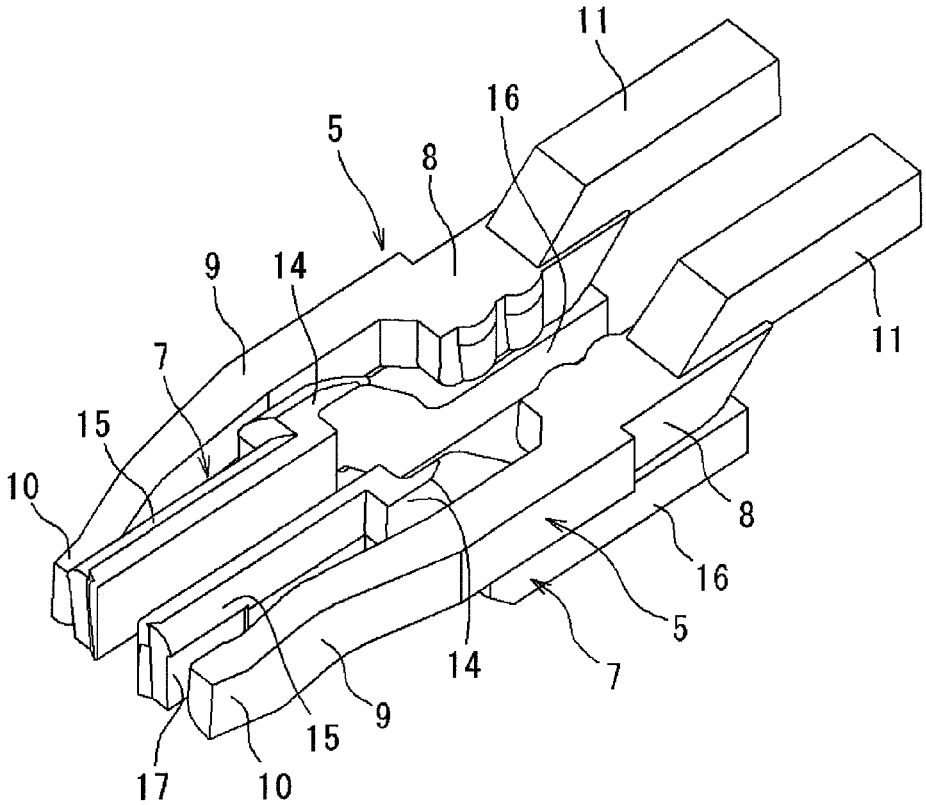
FIG. 13 is a perspective view showing an engaged state between the female-type contacts and the male-type contacts of FIG. 2.

As shown in FIG. 13, when the plug 3 is fitted into the socket 2, the spring portions 9 of the female-type contacts 5 are extended so as to surround the retention portions 14 of the male-type contacts 7, and the contact projections 13 are brought into press contact with the contact surfaces 17 by elasticity of the spring portions 9.

Figure 14:
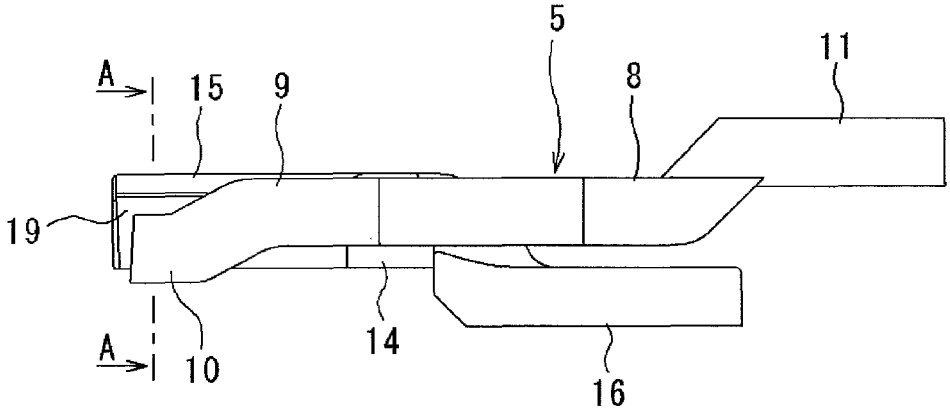
FIG. 14 is a side view of the female-type contacts and the male-type contacts of FIG. 13.

At this time, the electrode portions 11, 16 of the female-type contacts 5 and the male-type contacts 7 are disposed offset in opposite directions from each other as shown in FIG. 14.

Figure 15:
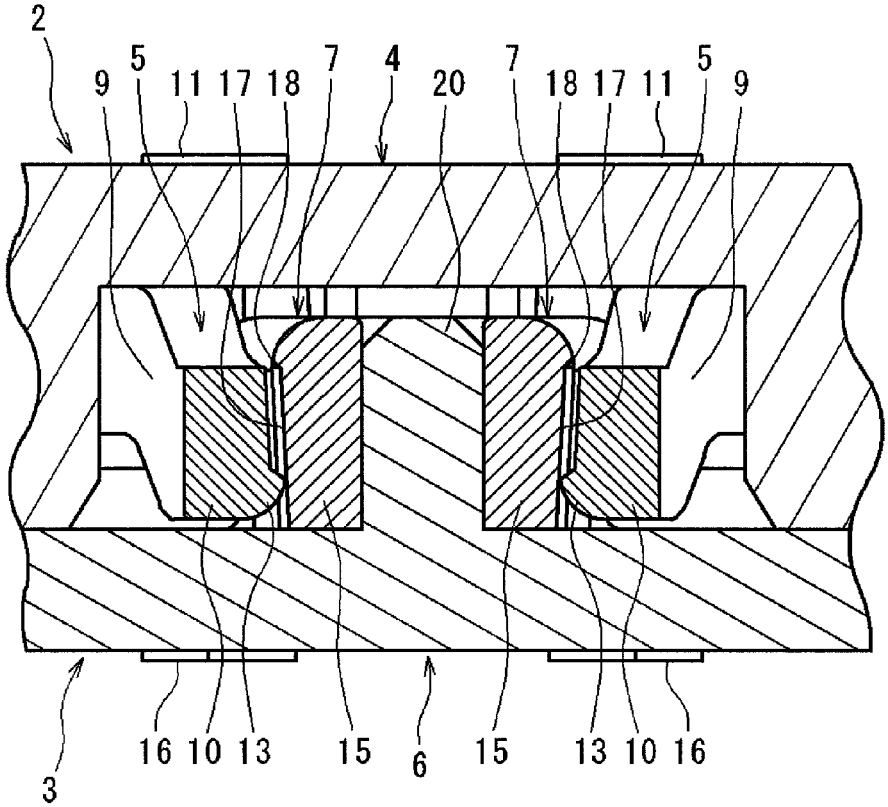
FIG. 15 is a partial cross sectional view in contact portions of the female-type contacts and the male-type contacts of the connector of FIG. 1.

Further, FIG. 15 shows an A-A cross section of the connector 1 in FIG. 14. As shown in the figure, the contact surfaces 17 of the pair of the male-type contacts 7, which are disposed back to back with a partition 20 of the housing 6 interposed therebetween, are interposed by the contact projections 13 of the contact portions 10 of the pair of the female-type contacts 5.

The paired contact surfaces 17, which are interposed by the pair of the contact projections 13, are slightly slanted so that a distance between the paired contact surfaces 17 decreases as the socket 2 and the plug are deeply fitted with each other. This makes it difficult for the socket 2 and the plug 3 to be separated from each other.

Furthermore, when the female-type contacts 5 and the male-type contacts 7 are engaged with each other, and when the female-type contacts 5 and the male-type contacts 7 are separated from each other, it is necessary to greatly elastically deform the female-type contacts 5 so that the contact projections 13 of the female-type contacts 5 go over the level differences 18 of the male-type contacts 7. Therefore, when the socket 2 and the plug 3 are fitted with and separated from each other, resistance momentarily increases when respectively making the contact projections 13 go over the level differences 18. By this, a user feels a so-called click feeling so as to be able to perceive a change in a fitting state between the socket 2 and the plug 3.

Figure 16:
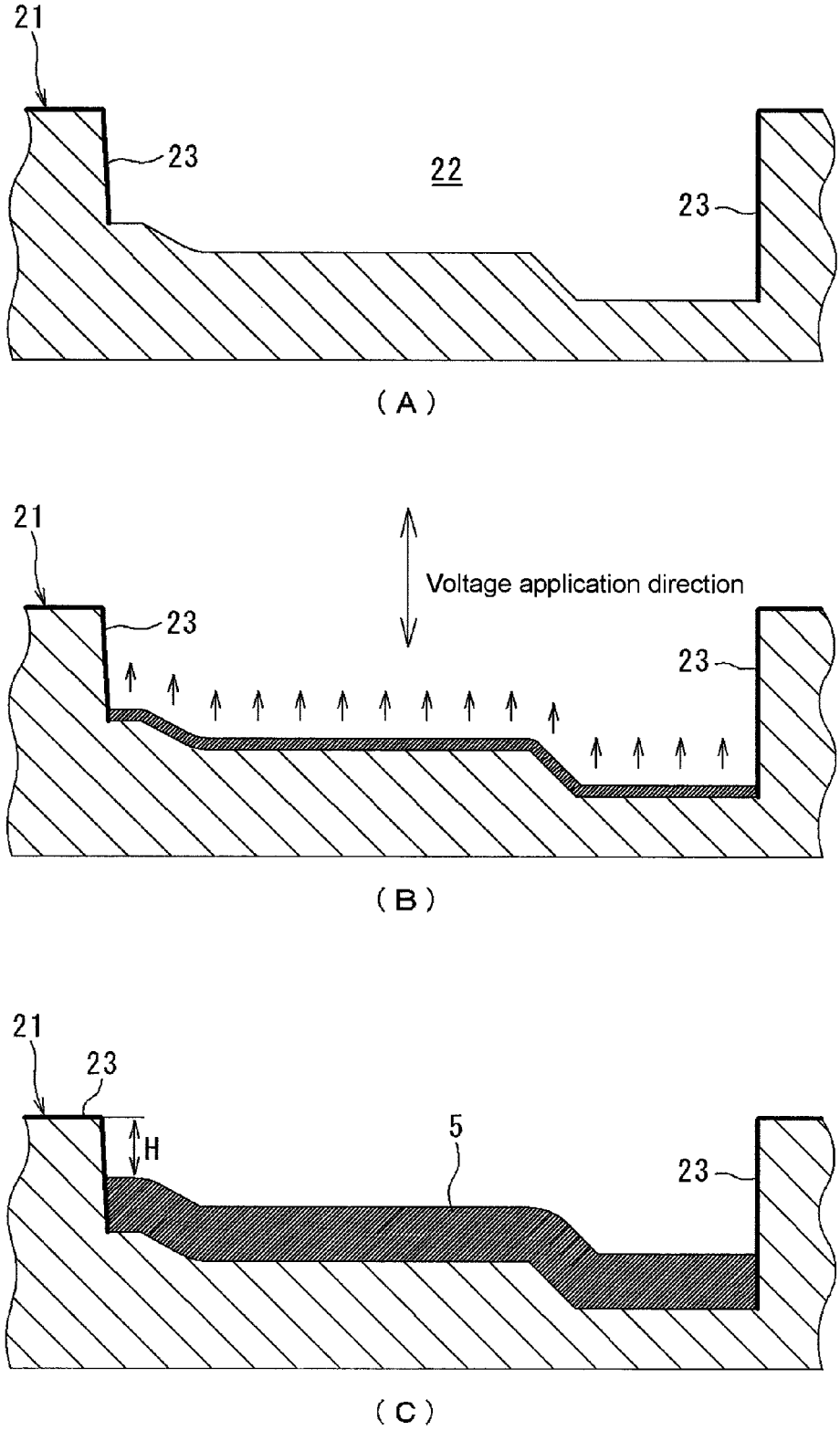
FIG. 16 shows a production process of the female-type contact of FIG. 5, which is shown in longitudinal cross sectional views of a mold.

Subsequently, a production process of the female-type contact 5 is shown in FIG. 16(A) through FIG. 16(C). According to one or more embodiments of the present invention, the female-type contact 5 is formed by electroforming. For electroforming of the female-type contact, first, as shown in FIG. 16(A), a cavity 22 having an inverted shape of that of the female-type contact 5 is formed in a conductive mold 21, and an insulating film 23 is formed on an outer surface of the mold 21, and on side wall surfaces of the cavity 22. Then, the mold 21 is dipped in an electrolyte in an electrolysis tank, and disposed so as to face a counter electrode (not shown). If a voltage is applied between the mold 21 and the counter electrode, a current flows through an electrolyte between a portion of the mold 21 not covered by the insulating film and the counter electrode so that a metal in the electrolyte is electrodeposited on a bottom surface of the cavity 22.

If a voltage is applied between the mold 21 and the counter electrode, and a current is kept flowing, the electrodeposited metal layer is stacked and grown in a voltage application direction as shown in FIG. 16(B). In one or more embodiments of the present invention, as shown in FIG. 16(C), electroforming is halted so as to leave a sufficient head space in the cavity 22 where the metal layer has grown by electrodeposition. In other words, it is necessary to form the cavity 22 deep enough, compared with a desired dimension of the female-type contact 5.

In one or more embodiments of the present invention, the head space to be left in the cavity 22 has a minimum height H that is at least one third, preferably at least two thirds, the cavity 22 width (a length in a direction in which the transverse distance becomes shorter). Thereby, an upper part of the insulating layer formed on the cavity side wall surfaces blocks a current that attempts to flow in at an angle to the metal layer already electrodeposited from a portion of the counter electrode, which is not directly across from the cavity 22, so there is no variation in the thickness of the metal to be electrodeposited. Accordingly, the metal layer formed by electroforming grows uniformly so as to have a constant thickness from the bottom surface of the cavity 22.

The female-type contact formed by electroforming, while leaving a sufficient head space in the cavity 22, has a shape whose height is roughly constant in the voltage application direction in electroforming. Further, since a width in a direction perpendicular to the voltage application direction thereof depends on the shape of the cavity 22, it is possible to freely design the female-type contact 5.

It can be considered that the spring portion 9 is a plate spring in which the width of the cavity 22 is a plate thickness and the height in the voltage application direction in electroforming of the metal layer grown by electrodeposition is a plate width. That is, the spring portion 9 can be identified as a plate spring that elastically deforms so that the respective portions are moved in a plane perpendicular to the voltage application direction in electroforming. Since the plate thickness of this plate spring can be changed depending on the shape of the cavity 22, it is possible to provide a preferred elastic force by giving a desired change to the elastic force. Furthermore, since a change in the thickness of this spring portion 9 is realized without machining, no deterioration in mechanical characteristics occurs due to the influence of a residual stress, deterioration by heat and the like, and no variation in elastic force occurs on a product-to-product basis.

In addition, the socket 2 is fitted to the plug 3 in the voltage application direction in electroforming the female-type contact 5. Thereby, the contact portions 10 of the female-type contacts 5 are brought into sliding contact with the male-type contacts 7 in the voltage application direction in electroforming. In the socket 2, the female-type contacts 5 are disposed so that spaces required for elastic deformation of the spring portions 9 and spaces occupied respectively by the retention portions 8 and the contact portions 10 are not superimposed in the fitting direction. Thereby, the connector 1 is shortened in the fitting direction, which coincides with the voltage application direction in electroforming, to achieve the height reduction.

Furthermore, by changing the depth of the cavity 22, it is also possible to curve the female-type contact 5 so that the retention portion 8 and the contact portion 10 are displaced (are at different levels) in the voltage application direction.

In particular, the present embodiment is characterized in that the spring portion 9 is curved in the voltage application direction so that the contact portion 10 gets closer to the counter electrode during electroforming. By this, when the socket 2 and the plug 3 are fitted to each other as shown in FIG. 15, the contact portions 10 are fitted deep into the plug 3, thus making it possible to increase a distance (fitting length) at which the contact projections 13 are brought into sliding contact with the contact surfaces 17. By increasing the fitting length, a conductive contact between the female-type contact 5 and the male-type contact 7 is secured, and an operational feeling of fitting and separating the socket 2 and the plug 3 is improved.

Figure 17:
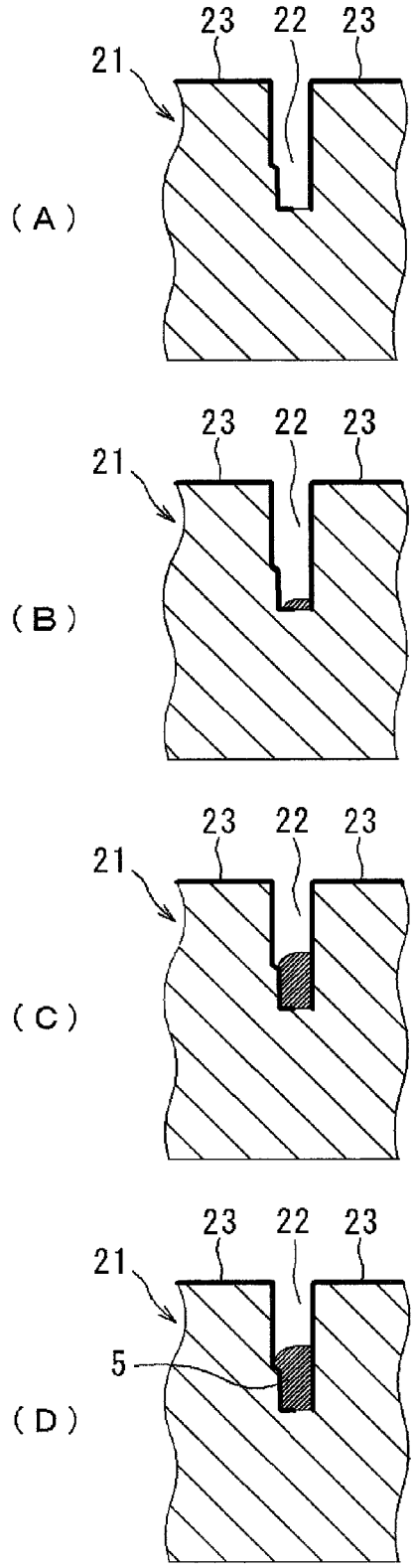
FIG. 17 shows a production process of the female-type contact of FIG. 5, which is shown in cross sectional views at a contact portion of the mold.

Furthermore, FIG. 17(A) through FIG. 17(D) show a process of electroforming the female-type contact 5, which is shown in cross sections of the contact portion 10. As shown in FIG. 17(A), the cavity 22 has, in the middle of its depth, a level difference formed on the side wall surfaces so as to expand an opening area. In addition, the insulating film 23 is formed so as to cover the level difference on the side wall surfaces of the cavity 22 and protrude to a part of the bottom surface thereof.

If a voltage is applied between the mold 21 and the counter electrode, a metal is electrodeposited on a portion of the bottom surface of the cavity 22, which is not covered by the insulating film 23. If a current is further passed, as shown in FIG. 17(B), a metal layer spreads also over the insulating film 23 covering a part of the bottom surface. At this time, the metal layer covering the insulating film 23 of the bottom surface of the cavity 22 grows later than a metal layer electrodeposited on the portion not covered by the insulating film 23.

If electroforming is further advanced, as shown in FIG. 17(C), the electrodeposited metal layer reaches the level difference on the side wall surfaces. Also in this case, by further continuation of electroforming, the metal layer spreads over the level difference on the side wall surfaces. That is, the contact projection 13 of the female-type contact 5 is formed by the level difference formed on the side wall surfaces of the cavity 22, and an inclination of an upper part of the contact projection 13 (counter electrode side) is formed due to delay of electrodeposition, which is attributable to the absence of the mold 21 not covered by the insulating film immediately beneath the inclination.

Although the description is omitted, the shape of the male-type contact 7 can be formed by the electroforming technique described in connection with the female-type contact 5.

Figure 18:
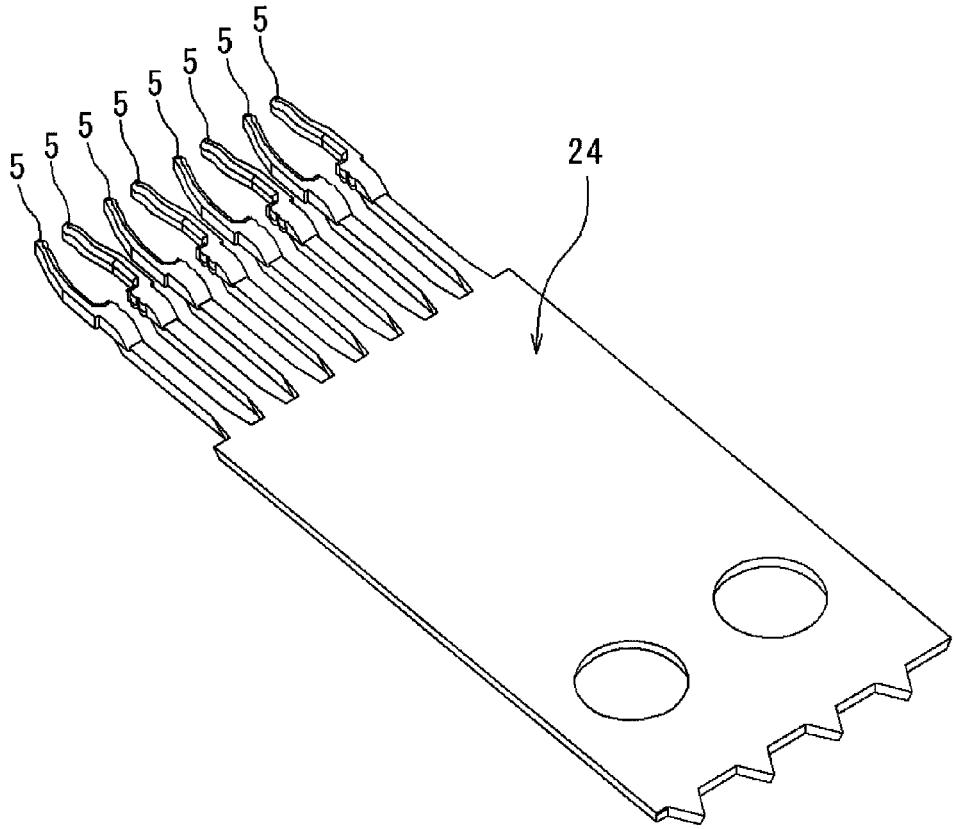
FIG. 18 is a perspective view showing a state in which the female-type contacts of FIG. 5 are molded integrally with a hoop.
Figure 19:
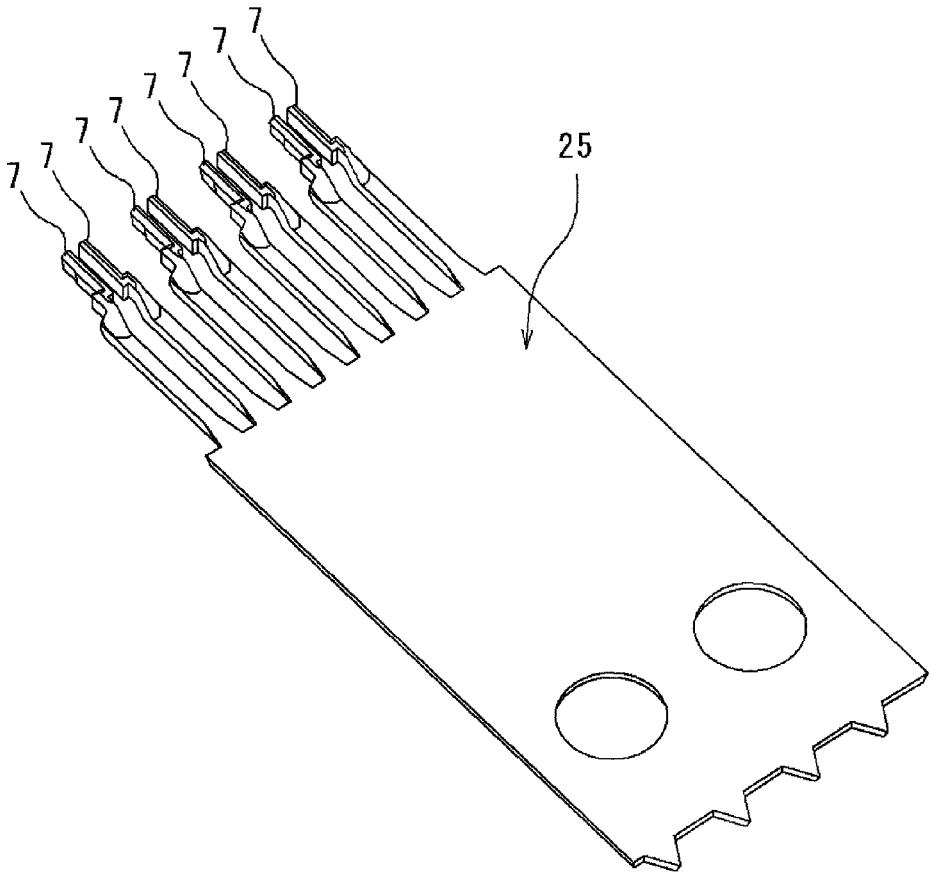
FIG. 19 is a perspective view showing a state in which the male-type contacts of FIG. 9 are molded integrally with a hoop.

In addition, according to the electroforming technique, as shown in FIG. 18, a plurality of the female-type contacts 5, which are retained in series with the socket 2, can be formed concurrently with a hoop 24 that is extended from the electrode portions 11 so that the female-type contacts 5 and the hoop 24 are connected with each other. Similarly, as shown in FIG. 19, a plurality of the male-type contacts 7, which are retained in series with the plug 2, can also be formed concurrently with a hoop 25 that is extended from the electrode portions 16 so that the male-type contacts 7 and the hoop 25 are connected with each other.

By this, the female-type contacts 5 and the male-type contacts 7 are formed integrally with the hoops 24, 25 in a state in which the female-type contacts 5 and the male-type contacts 7 are arranged at a pitch in which they are arranged in the housings 4, 6. Thus, it is possible to allow the housings 4, 6 to retain the female-type contacts 5 and the male-type contacts 7 collectively, with the hoops 24, 25 retained therein.

INDUSTRIAL APPLICABILITY

It is a matter of course that the contacts and the connector according to the present are not limited to the above embodiment, and can be applied to other contacts and connectors.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A contact formed by electroforming and extended in a direction roughly perpendicular to a voltage application direction in the electroforming, the contact comprising:

a contact portion disposed at one end of the contact, which is brought into sliding contact with a conductive member along the voltage application direction in the electroforming, wherein the contact has a retention portion fixed by an insulating material and an elastically deformable spring portion that connects the contact portion and the retention portion, wherein the spring portion elastically deforms in the direction perpendicular to the voltage application direction in the electroforming, and wherein the retention portion is located on the same side as a retention portion of another type of contact to be electrically connected thereto.

2. The contact according to claim 1, wherein the spring portion is curved in the voltage application direction.

3. The contact according to claim 1, wherein an electrode portion connected to a circuit is extended from the retention portion to an opposite side of the spring portion.

4. The contact according to claim 1, wherein an end of the contact portion is provided with a press-fitting portion, which is formed by continuously protruding only a portion of the end of the contact portion in the voltage application direction in the electroforming.

5. A connector in which a plurality of the contacts according to claim 1 are arranged and retained in the direction perpendicular to the voltage application direction in the electroforming.

6. A connector comprising:

a first connection member in which a plurality of the contacts according to claim 1 are arranged and retained in the direction perpendicular to the voltage application direction in the electroforming; and a second connection member in which a plurality of the conductive members, which are brought into contact with the contact portions of the contacts, are arranged and retained in the voltage application direction in the electroforming.

7. The connector according to claim 6, wherein each of the conductive members is a contact in which an end of the contact portion is provided with a press-fitting portion, which is formed by continuously protruding only a portion of the end of the contact portion in the voltage application direction in the electroforming.

* * * * *